US008022907B2

(12) United States Patent
Park et al.

(10) Patent No.: US 8,022,907 B2
(45) Date of Patent: Sep. 20, 2011

(54) BRIGHTNESS CONTROLLED ORGANIC LIGHT EMITTING DISPLAY AND METHOD OF DRIVING THE SAME

(75) Inventors: Young Jong Park, Seoul (KR); Kyoung Soo Lee, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 988 days.

(21) Appl. No.: 11/374,122

(22) Filed: Mar. 14, 2006

(65) Prior Publication Data

US 2006/0220578 A1 Oct. 5, 2006

(30) Foreign Application Priority Data

Mar. 31, 2005 (KR) ..... 10-2005-0027333

(51) Int. Cl.
*G09G 3/30* (2006.01)

(52) U.S. Cl. ..... 345/77

(58) Field of Classification Search ..... 345/77
See application file for complete search history.

(56) References Cited

U.S. PATENT DOCUMENTS

| | | | | |
|---|---|---|---|---|
| 6,160,592 | A * | 12/2000 | Yoon | 348/687 |
| 6,278,436 | B1 * | 8/2001 | Hosoi et al. | 345/30 |
| 2002/0011978 | A1 * | 1/2002 | Yamazaki et al. | 345/87 |
| 2003/0030655 | A1 * | 2/2003 | Ooe et al. | 345/690 |
| 2004/0160168 | A1 | 8/2004 | Lee et al. | |
| 2005/0057580 | A1 * | 3/2005 | Yamano et al. | 345/690 |
| 2005/0116903 | A1 * | 6/2005 | Shin | 345/76 |
| 2005/0212787 | A1 * | 9/2005 | Noguchi et al. | 345/204 |
| 2005/0243077 | A1 * | 11/2005 | Chung et al. | 345/204 |
| 2005/0243223 | A1 * | 11/2005 | Slobodin | 349/7 |
| 2006/0267881 | A1 * | 11/2006 | Jeon et al. | 345/75.2 |

FOREIGN PATENT DOCUMENTS

| | | |
|---|---|---|
| JP | 11-024631 | 1/1999 |
| JP | 2000-259110 | 9/2000 |
| JP | 2003-228331 | 8/2003 |
| JP | 2003-255884 | 9/2003 |
| JP | 2003-280589 | 10/2003 |
| JP | 2003-330418 | 11/2003 |
| JP | 2004-029755 | 1/2004 |
| JP | 2004-294752 | 10/2004 |
| JP | 2004-309810 | 11/2004 |
| JP | 2005-055726 | 3/2005 |
| JP | 2006-276718 | 10/2006 |
| WO | WO 2004023446 A1 * | 3/2004 |
| WO | 2005/006291 | 1/2005 |

* cited by examiner

*Primary Examiner* — Richard Hjerpe
*Assistant Examiner* — Andrew Schnirel
(74) *Attorney, Agent, or Firm* — H.C. Park & Associates, PLC

(57) ABSTRACT

An organic light emitting display includes a brightness controller that restricts the total brightness of a pixel unit when the number of pixels that emit bright light is greater than a predetermined level.

13 Claims, 8 Drawing Sheets

BRIGHTNESS CONTROLLED ORGANIC LIGHT EMITTING DISPLAY AND METHOD OF DRIVING THE SAME

CROSS REFERENCE TO RELATED APPLICATION

This application claims priority to and the benefit of Korean Patent Application No. 2005-27333, filed on Mar. 31, 2005, which is hereby incorporated by reference for all purposes as if fully set forth herein.

BACKGROUND

1. Field of the Invention

The present invention relates to an organic light emitting display and a method of driving the same, and more particularly, to an organic light emitting display in which brightness is restricted in accordance with an emission area and the amount of change in the brightness varies with the emission area and a method of driving the same.

2. Discussion of the Background

Light emitting displays may be classified as either organic light emitting displays, which use organic light emitting diodes (OLED) and inorganic light emitting displays, which use inorganic light emitting diodes.

An OLED includes an anode electrode, a cathode electrode, and an organic emission layer positioned between the anode electrode and the cathode electrode. The organic emission layer emits light by combining electrons and holes.

An inorganic light emitting diode, referred to as a light emitting diode (LED), includes an emission layer formed of inorganic material such as a PN-junction semiconductor.

FIG. 1 illustrates the structure of a conventional organic light emitting display. Referring to FIG. 1, the conventional light emitting display includes a pixel unit 10, a data driver 20, a scan driver 30, and a power source supply unit 40.

The pixel unit 10 includes a plurality of pixels 11, each of which is connected to an OLED (not shown). The pixel unit 10 also includes n number of scan lines S1, S2, . . . , Sn-1, and Sn arranged in a row direction to transmit scan signals, n number of emission control signal lines E1, E2, . . . , En-1, and En arranged in a row direction to transmit emission control signals, m number of data lines D1, D2, . . . , Dm-1, and Dm arranged in a column direction to transmit data signals, m number of first power source supply lines (not shown) for transmitting a first power source ELVdd, and m number of second power source supply lines (not shown) for transmitting a second power source ELVss with a lower potential than the potential of the first power source ELVdd.

The brightness and duration of emission of light emitted by the OLEDs in the pixel units 10 are controlled to display images by the scan signals, the emission control signals, the data signals, the first power source ELVdd, and the second power source ELVss.

The data driver 20 applies data signals to the pixel unit 10 through the data lines D1, D2, . . . , Dm-1, and Dm.

The scan driver 30 sequentially outputs the scan signals to the specific rows of the pixel unit 10 through the scan lines S1, S2, . . . , Sn-1, and Sn. The scan driver 30 sequentially outputs the emission control signal lines to the specific rows of the pixel units 10 through the emission control signal lines E1, E2, . . . , En-1, and En.

The data signals and scan signals are transmitted to the pixels 11 to generate a current that corresponds to the data signals. The currents flowing to the OLEDs are controlled by the emission control signals. When the scan signals and the emission control signals in all of the rows are sequentially selected, one frame is completed. Images are thus displayed by the emission of light from the OLEDs.

The power source supply unit 40 transmits the first power source ELVdd and the second power source ELVss to the pixel unit 10. The second power source ELVss has a lower potential than the first power source ELVdd. Currents corresponding to the data signals thus flow through the pixels 11 due to the difference in voltage between the first power source ELVdd and the second power source ELVss.

Organic light emitting displays such as the one described above require a large amount of current to flow through the pixel unit 10 for the pixel unit 10 to emit bright light and require a small amount of current to flow through the pixel unit 10 for the pixel unit 10 to emit dim light. A large load is applied to the power source supply unit 40 to produce enough current to produce bright light, which requires the power source supply unit 40 to have a high output capability.

The widths of the emission control signals may be used to control the brightness by controlling the amount of time during which light is emitted. However, when the brightness is low, the amount of time that the light is emitted may be so short that a viewer may perceive a flickering phenomenon.

SUMMARY OF THE INVENTION

This invention provides an organic light emitting display and method of driving the same in which the amount of current used is restricted to reduce the overall brightness of the display when the area of the pixel unit in which bright light is emitted is larger than a predetermined value. This may reduce power consumption and improve picture quality.

This invention also provides an organic light emitting display and method of driving the same in which the period of time in one frame during which light is emitted is divided to reduce the amount of time during which light is continuously not emitted to prevent a flicker phenomena and improve picture quality.

Additional features of the invention will be set forth in the description which follows, and in part will be apparent from the description, or may be learned by practice of the invention.

The present invention discloses an organic light emitting display that includes a pixel unit including a plurality of pixels, a scan driver that transmits scan signals and emission control signals to the pixel unit, a data driver that converts video data signals to data signals and transmits the data signals to the pixel unit, a brightness controller that restricts the brightness of the pixel unit by generating frame data by summing the video data corresponding to one frame and the brightness controller generating brightness control signals to restrict the brightness of the pixel unit based on the magnitude of the frame data, and an emission controller that controls the emission control signals in response to the brightness control signals from the brightness controller.

The present invention also discloses a method of driving an organic light emitting display, including generating frame data by summing the video data corresponding to one frame, and restricting the brightness of a pixel unit when the magnitude of the frame data is greater than a predetermined level and not restricting the brightness of the pixel unit when the magnitude of the frame data is equal to or less than the predetermined level.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
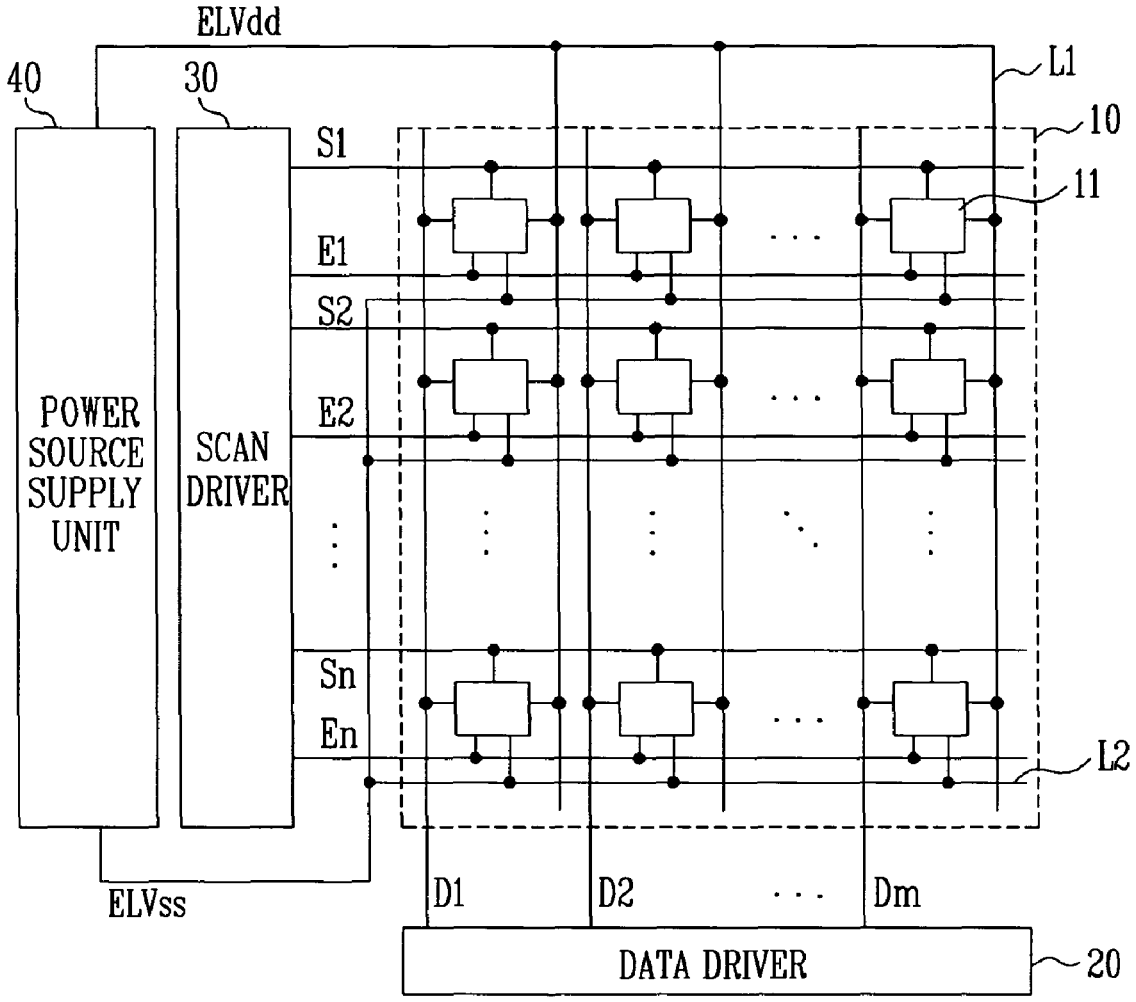
FIG. 1 (PRIOR ART)
FIG. 1 shows the structure of a conventional organic light emitting display.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 2:
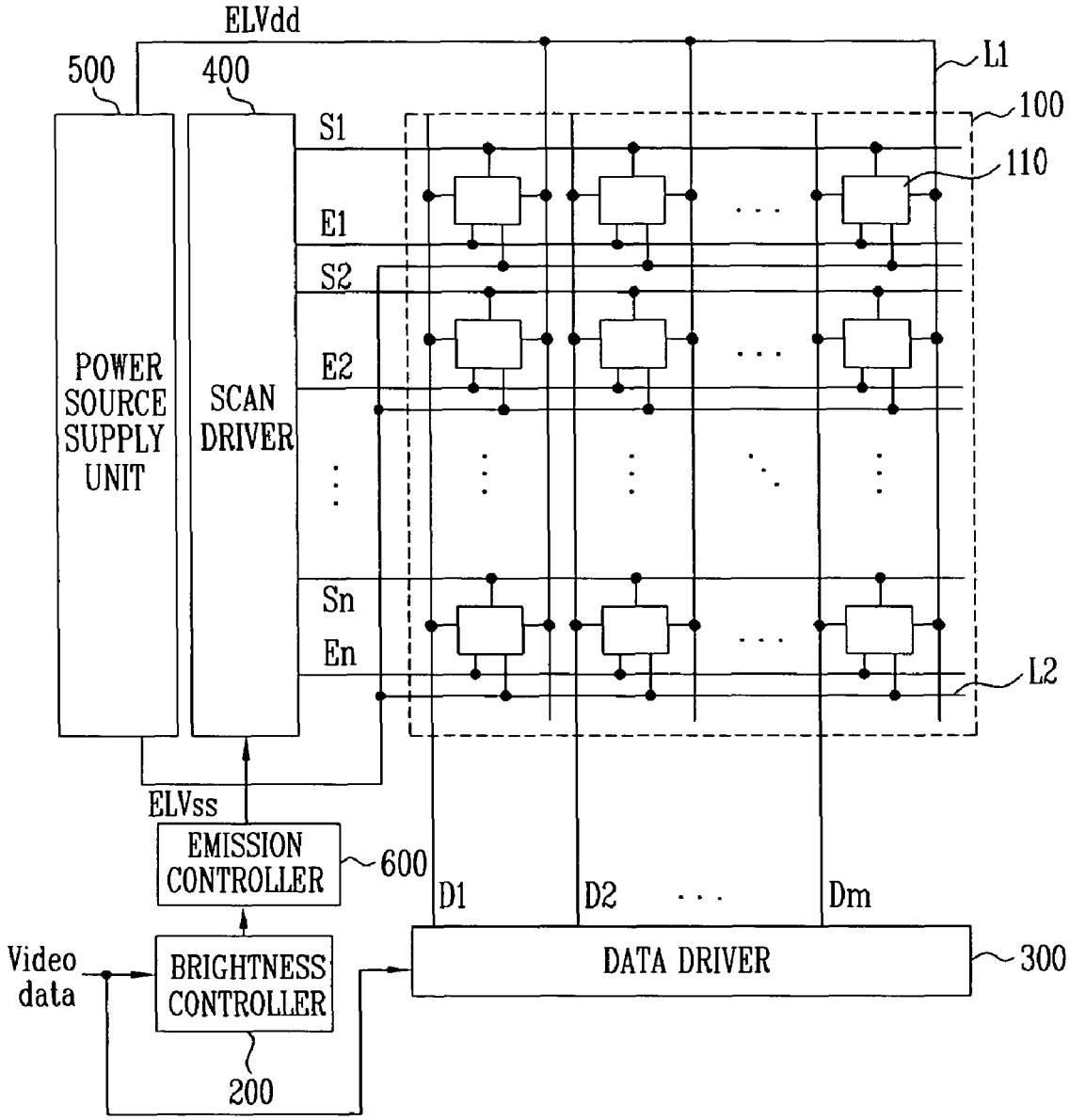
FIG. 2 shows the structure of an organic light emitting display according to an exemplary embodiment of the present invention.

FIG. 2 illustrates the structure of an organic light emitting display according to an exemplary embodiment of the present invention. Referring to FIG. 2, the organic light emitting display may include a pixel unit 100, a brightness controller 200, a data driver 300, a scan driver 400, a power source supply unit 500, and an emission controller 600.

The pixel unit 100 may include a plurality of pixels 110, each of which is connected to an organic light emitting diode (OLED) (not shown). The pixel unit 100 may further include n number of scan lines S1, S2, . . . , Sn-1, and Sn arranged in a row direction to transmit scan signals, n number of emission control lines E1, E2, . . . , En-1, and En arranged in a row direction to transmit emission control signals, m number of data lines D1, D2, . . . , Dm-1, and Dm arranged in a column direction to transmit data signals, first power source lines L1 for transmitting a first power source ELVdd to the pixels 110, and second power source lines L2 for transmitting a second power source ELVss to the pixels 110. The second power source lines L2 may be formed in the entire region of the pixel unit 100 to be electrically connected with the pixels 110.

The brightness controller 200 outputs brightness control signals to restrict the brightness of the pixel unit 100 so that the brightness of the pixel unit 100 does not exceed a predetermined level. The pixel unit 100 will be brighter when a large area of the pixel unit 100 emits bright light than when a smaller area of the pixel unit 100 emits bright light. Also, the pixel unit 100 will be brighter when the pixel unit 100 emits full white light than when the pixel unit 100 does not emit full white light.

The brightness controller 200 may reduce the brightness of the pixel unit 100 to a predetermined level when the pixel unit 100 emits bright light over a large area. The level to which the brightness of the pixel unit 100 is restricted varies with the area over which the pixel unit 100 emits bright light. Therefore, the brightness of the pixel unit 100 changes in accordance with the change in the area over which the pixel unit 100 emits bright light.

The frame data is the sum of video data signals input in one frame. A large amount of current flows through the pixel unit 100 when the magnitude of the frame data is large and, conversely, a small amount of current flows through the pixel unit 100 when the magnitude of the frame data is small. The brightness controller 200 outputs brightness control signals to restrict the brightness of the pixel unit 100 when the magnitude of a frame data signal is greater than a predetermined value so that the brightness of the images displayed by the pixel unit 100 is reduced.

When the brightness of the pixel unit 100 is restricted by the brightness controller 200, the amount of current that flows through the pixel unit 100 is also restricted. Therefore, the output of the power source supply unit 500 is not required to be as high.

When the brightness of the pixel unit 100 is not restricted, the time during which the pixels emit light is increased so that the brightness of the pixel unit 100 increases. This increases the contrast between the pixels that emit light and the pixels that do not emit light and improves the contrast of the pixel unit 100. The time during which the pixels emit light is individually determined per frame.

When the time during which the pixels emit light is reduced in order to reduce the amount of current that flows through the pixel unit 100, the time during which current is supplied is also reduced. The amount of current flowing to the pixels is only reduced by reducing the amount of time that the current flows to the pixels. However, when the time during which light is emitted is reduced, the time during which light is not emitted necessarily increases, and the periods during which light is not emitted may be perceived by a viewer as a flickering phenomenon. Therefore, in order to prevent the generation of flicker, the period of time in one frame during which light is emitted is divided to reduce the amount of time during which light is continuously not emitted. This will prevent a viewer from perceiving the periods of time during which light is not emitted and will thus prevent the flickering phenomenon.

The data driver 300 applies the data signals to the pixel unit 100. The data driver 300 receives video data that has red, blue, and green components to generate data signals. The data driver 300 is connected with the data lines D1, D2, . . . , Dm-1, and Dm of the pixel unit 100 to apply the generated data signals to the pixel unit 100.

The scan driver 400 applies the scan signals and the emission control signals to the pixel unit 100. The scan driver 400 is connected with the scan lines S1, S2, . . . , Sn-1, and Sn and the emission control lines E1, E2, . . . , En-1, and En to transmit the scan signals and the emission control signals to the specific rows of the pixel unit 100. The scan driver 400 uses the brightness control signals to output the correct emission control signals.

The scan driver 400 may be divided into a scan driving circuit for generating the scan signals and an emission driving circuit for generating the emission control signals. The scan driving circuit and the emission driving circuit may be included in one component or may be divided into separate components.

The data signals and the scan signals are transmitted to individual pixels 110. Currents corresponding to the emission control signals and the data signals are transmitted to the OLEDs so that the OLEDs emit light to display images. When all of the rows are sequentially selected, one frame of motion is completed.

The power source supply unit 500 transmits a first power source ELVdd and a second power source ELVss to the pixel unit 100. The currents corresponding to the data signals flow through the pixels due to a difference in voltage between the first power source ELVdd and the second power source ELVss.

The emission controller 600 controls the pulse widths of the emission control signals transmitted through the emission control signal lines E1, E2, . . . , En-1, and En to control the time during which the pixel unit 100 emits light within one frame. When the pulse widths are large, the amount of current received by the pixel unit 100 increases so that the overall brightness of the pixel unit 100 is not reduced. When the pulse widths are small, the amount of current received by the pixel unit 100 is reduced so that the overall brightness of the pixel unit 100 is reduced.

The emission controller 600 outputs emission control signals with two or more emission periods in one frame when the widths of the emission control signals are reduced to a predetermined level by the brightness control signals to reduce the duration of continuous non-emission periods. This method reduces the duration of continuous non-emission periods so that the periods during which the pixels do not emit light may not be perceived by a viewer as a flickering phenomenon.

Figure 3:
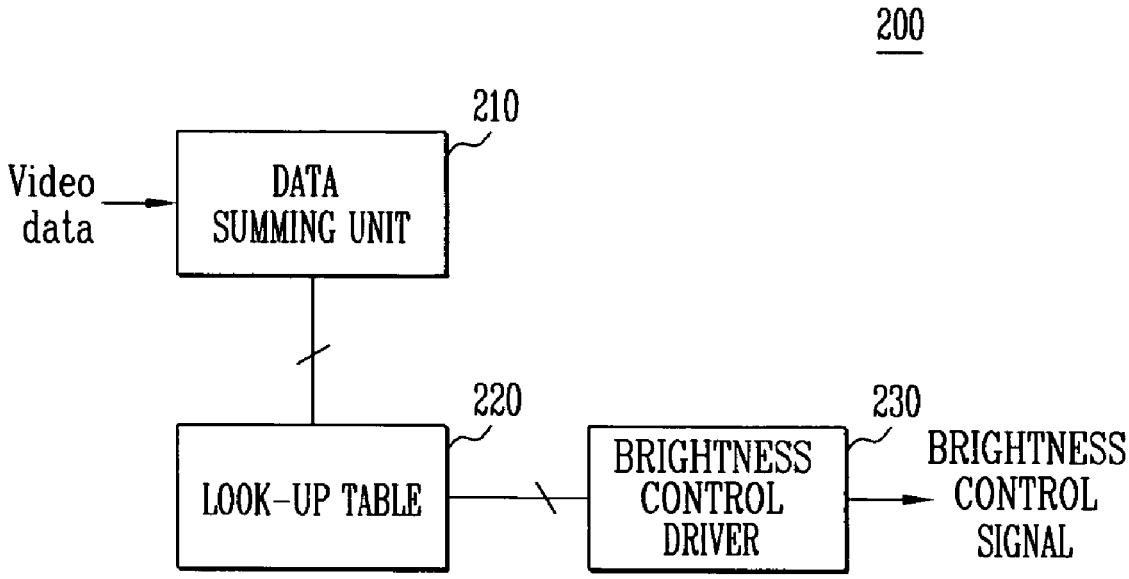
FIG. 3 shows an example of a brightness controller that may be used for the organic light emitting display according to an exemplary embodiment of the present invention.

FIG. 3 illustrates a brightness controller that may be used with the organic light emitting display according to an exemplary embodiment of the present invention. Referring to FIG. 3, the brightness controller 200 may include a data summing unit 210, a look-up table 220, and a brightness control driver 230.

The data summing unit 210 extracts information on frame data by adding the red, blue, and green components ofthe video data input in one frame. The frame data will be large when there are a large number of data items within the frame that display high gray scales. Conversely, the frame data will be small when the number of data items that display high gray scales within the frame is small.

In the look-up table 220, the widths of the emission periods of the emission control signals are determined in accordance with the values of the frame data. The widths of the emission periods are determined by the upper bits of the frame data. The brightness of the pixel unit 100 in one frame can be determined by the upper five bits of the frame data.

As the magnitude of the frame data increases, the brightness of the pixel unit 100 increases. The brightness of the pixel unit 100 is restricted when the brightness of the pixel unit 100 becomes greater than a predetermined level. As the brightness of the pixel unit 100 increases, the restriction ratio increases to prevent the brightness of the pixel unit 100 from increasing excessively.

The brightness of the pixel unit 100 may be excessively restricted when the brightness of the pixel unit 100 is extremely high so that it may not be possible to provide a sufficiently bright screen and the overall brightness may therefore be reduced. To avoid this problem, the level at which the brightness of the pixel unit 100 is maximally restricted may be determined at the level of brightness of the pixel unit 100 when the entire pixel unit 100 displays white so that the brightness of the pixel unit 100 will not be reduced to less than the level at which the brightness of the pixel unit 100 is restricted.

The restriction range may vary according to whether the images displayed by the organic light emitting display are still images or moving images The brightness of the pixel unit 100 is not restricted when the magnitude of the frame data is less than a predetermined level so that the brightness of the pixel unit 100 is not restricted when the brightness of the pixel unit 100 is low.

TABLE 1 is an exemplary embodiment of the look-up table 220 in which the emission ratio is restricted to 50% of the maximum value of the brightness of the pixel unit 100.

TABLE 1

| Values of upper five bits | Emission rate | Emission ratio | Brightness | Widths of emission control signals |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 100% | 300 | 325 |
| 6 | 22% | 100% | 300 | 325 |
| 7 | 25% | 100% | 300 | 325 |
| 8 | 29% | 100% | 300 | 325 |
| 9 | 33% | 100% | 300 | 325 |
| 10 | 36% | 100% | 300 | 325 |
| 11 | 40% | 99% | 297 | 322 |
| 12 | 43% | 98% | 295 | 320 |
| 13 | 47% | 96% | 287 | 311 |
| 14 | 51% | 93% | 280 | 303 |
| 15 | 54% | 89% | 268 | 290 |
| 16 | 58% | 85% | 255 | 276 |
| 17 | 61% | 81% | 242 | 262 |
| 18 | 65% | 76% | 228 | 247 |
| 19 | 69% | 72% | 217 | 235 |
| 20 | 72% | 69% | 206 | 223 |
| 21 | 76% | 65% | 196 | 212 |
| 22 | 79% | 62% | 186 | 202 |
| 23 | 83% | 60% | 179 | 194 |
| 24 | 87% | 57% | 172 | 186 |
| 25 | 90% | 55% | 165 | 179 |
| 26 | 94% | 53% | 159 | 172 |
| 27 | 98% | 51% | 152 | 165 |
| 28 | — | — | — | — |
| 29 | — | — | — | — |
| 30 | — | — | — | — |
| 31 | — | — | — | — |

TABLE 1 may be applied to still images. The brightness is not restricted when the emission rate of the pixel unit 100 is less than 36% but is restricted when the rate of the emission area exceeds 36%. The rate of restricting the brightness increases when the area in which the pixel unit 100 emits light with the maximum brightness increases. The emission rate is a variable determined by EQUATION 1.

$$\text{Emission rate} = \frac{\text{Brightness of one frame}}{\text{Brightness of pixel unit that emits light in full white}} \quad \text{[EQUATION 1]}$$

In order to prevent excessive restriction on brightness, the maximum restriction rate is limited to 50% so that, even if most of the pixels 110 emit light with maximum brightness, the brightness restriction rate is no more than 50%.

TABLE 2 is an exemplary embodiment of the look-up table 220 in which the emission ratio is restricted to 33% of the maximum value in accordance with the brightness of the pixel unit 100.

TABLE 2

| Values of upper five bits | Emission rate | Emission ratio | Brightness | Widths of emission control signals |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 99% | 298 | 322 |
| 6 | 22% | 98% | 295 | 320 |
| 7 | 25% | 95% | 285 | 309 |
| 8 | 29% | 92% | 275 | 298 |
| 9 | 33% | 88% | 263 | 284 |
| 10 | 36% | 83% | 250 | 271 |
| 11 | 40% | 79% | 237 | 257 |
| 12 | 43% | 75% | 224 | 243 |
| 13 | 47% | 70% | 209 | 226 |
| 14 | 51% | 64% | 193 | 209 |
| 15 | 54% | 61% | 182 | 197 |
| 16 | 58% | 57% | 170 | 184 |
| 17 | 61% | 53% | 160 | 173 |
| 18 | 65% | 50% | 150 | 163 |
| 19 | 69% | 48% | 143 | 155 |
| 20 | 72% | 45% | 136 | 147 |
| 21 | 76% | 43% | 130 | 141 |
| 22 | 79% | 41% | 124 | 134 |
| 23 | 83% | 40% | 119 | 128 |
| 24 | 87% | 38% | 113 | 122 |
| 25 | 90% | 36% | 109 | 118 |
| 26 | 94% | 35% | 104 | 113 |
| 27 | 98% | 34% | 101 | 109 |
| 28 | — | — | — | — |
| 29 | — | — | — | — |
| 30 | — | — | — | — |
| 31 | — | — | — | — |

TABLE 2 may be applied to moving images. The brightness is not restricted when the emission rate of the pixel unit 100 is less than 14% but is restricted when the emission rate exceeds 14% . The rate of restricting the brightness increases when the area in which the pixel unit 100 emits light with the maximum brightness increases. In order to prevent excessive restriction on brightness, the maximum restriction rate is restricted to 33% so that even if most of the pixels 110 emit light with maximum brightness, the brightness restriction rate is no more than 33%.

The brightness control driver 230 receives and uses the upper five bit values of the frame data to output brightness control signals. The brightness control signals are input to the scan driver 400. The scan driver 400 outputs emission control signals in accordance with the brightness control signals. In an exemplary embodiment where the scan driver 400 is divided into a scan driving circuit and an emission control circuit, the brightness control signals are input to the emission control circuit, and the emission control signals are output in accordance with the brightness control signals.

The maximum emission period of the emission control signals may be set as 325. In order to generate the emission periods of the emission control signals represented in TABLE 1, the brightness control signals may be 9-bit signals because an 8-bit can express only 256 items, while a 9-bit can express 512 items. Start pulses may be used as the brightness control signals and the widths of the emission control signals may be determined in accordance with the change in the widths of the start pulses.

FIG. 4A, FIG. 4B, and FIG. 4C illustrate waveforms of the emission control signals generated by the emission driving circuit used for the organic light emitting display of FIG. 2. FIG. 4A illustrates a waveform where light is emitted once in one frame. FIG. 4B illustrates a waveform where light is emitted twice in one frame. FIG. 4C illustrates a waveform where light is emitted five times in one frame.

Referring to FIG. 4A, FIG. 4B, and FIG. 4C, one frame is divided into periods where the pixels emit light and periods where the pixels do not emit light. When light is emitted only once in one frame as illustrated in FIG. 4A, the periods in which light is not emitted may be perceived by a viewer as a flickering phenomenon.

When the period in which light is emitted in one frame is divided into multiple light emitting periods with periods in which light is not emitted between them, the total time that light is not emitted will remain the same, but the periods in which light is continuously not emitted will be reduced so that the periods in which light is not emitted may not be perceived by a viewer as a flickering phenomenon. Light may be emitted any number of times in one frame, for example, twice in one frame as illustrated in FIG. 4B or five times in one frame as illustrated in FIG. 4C.

Figure 4:
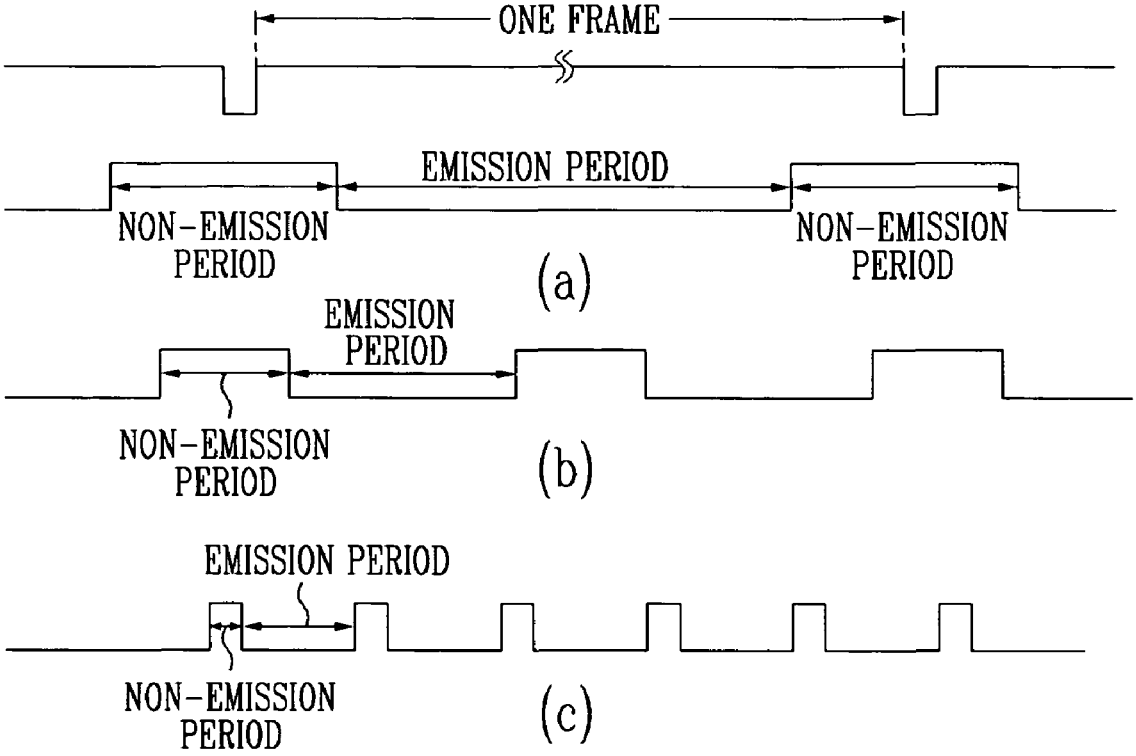
FIG. 4A, FIG. 4B, and FIG. 4C show waveforms of emission control signals generated by the emission driving circuit that may be used for the organic light emitting display of FIG. 2.
Figure 5:
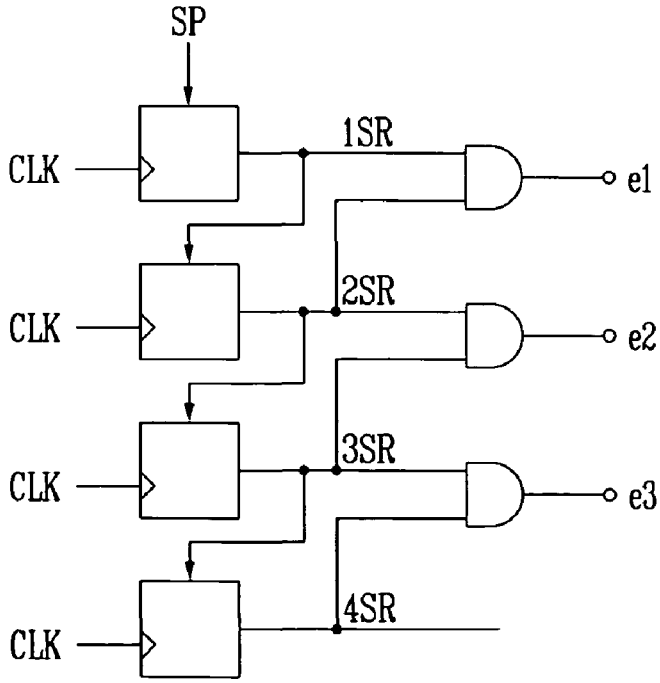
FIG. 5 shows an example of the emission driving circuit for generating the emission control signals of FIGS. 4A to 4C.

FIG. 5 illustrates an example of an emission driving circuit for generating the emission control signals of FIG. 4. Referring to FIG. 5, the emission driving circuit includes a shift register. A start pulse SP is input to the shift register to output a first shift signal 1SR by shifting the start pulse SP. The first shift signal 1SR may be shifted to output a second shift signal 2SR, the second shift signal 2SR may be shifted to output a third shift signal 3SR, and the third shift signal 3SR may be shifted to output a fourth shift signal 4SR. The above operations may be repeated to sequentially output n number of shift signals. An operation may then be performed on the first shift signal 1SR and the second shift signal 2SR to output a first emission control signal e1, on the second shift signal 2SR and the third shift signal 3SR to output a second emission control signal e2, and on the third shift signal 3SR and the fourth shift signal 4SR to output a third emission control signal e3. The operation may be repeated to generate n number of emission control signals. The shift signals are sequentially generated, which causes n number of emission control signals to be sequentially generated.

Light is emitted once in one frame when one start pulse SP is input in one frame, twice in one frame when two start pulses SP are input in one frame, and four times in one frame when four start pulses SP are input in one frame.

Figure 6A:
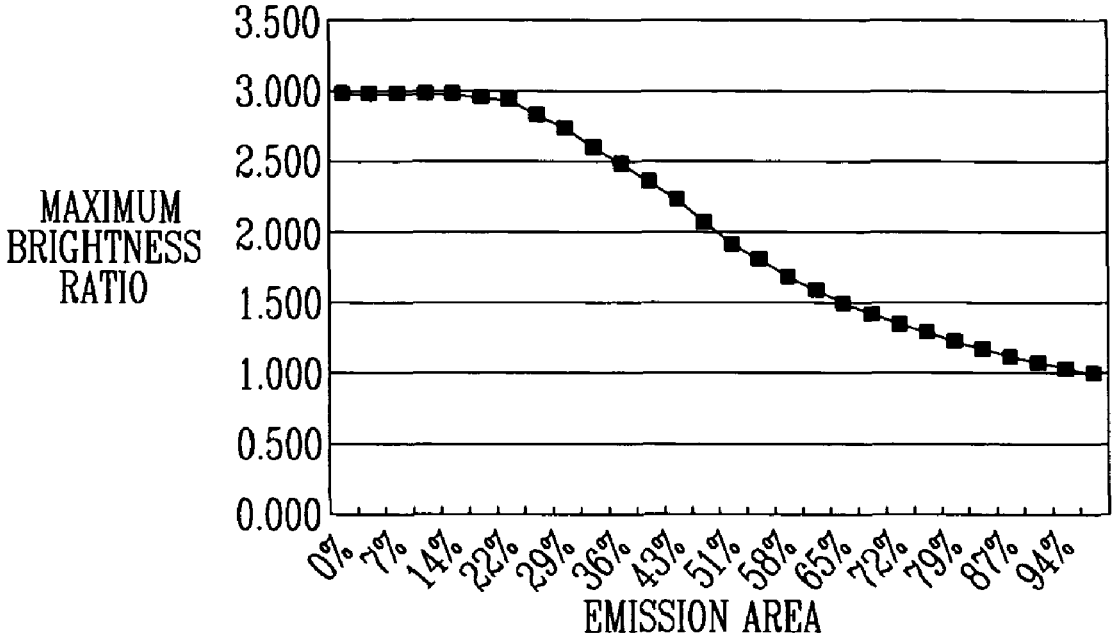
FIG. 6A, FIG. 6B, FIG. 6C, and FIG. 6D show cases in which restriction of 33% of the maximum current value of the light emitting display according to an exemplary embodiment of the present invention is performed.
Figure 6B:
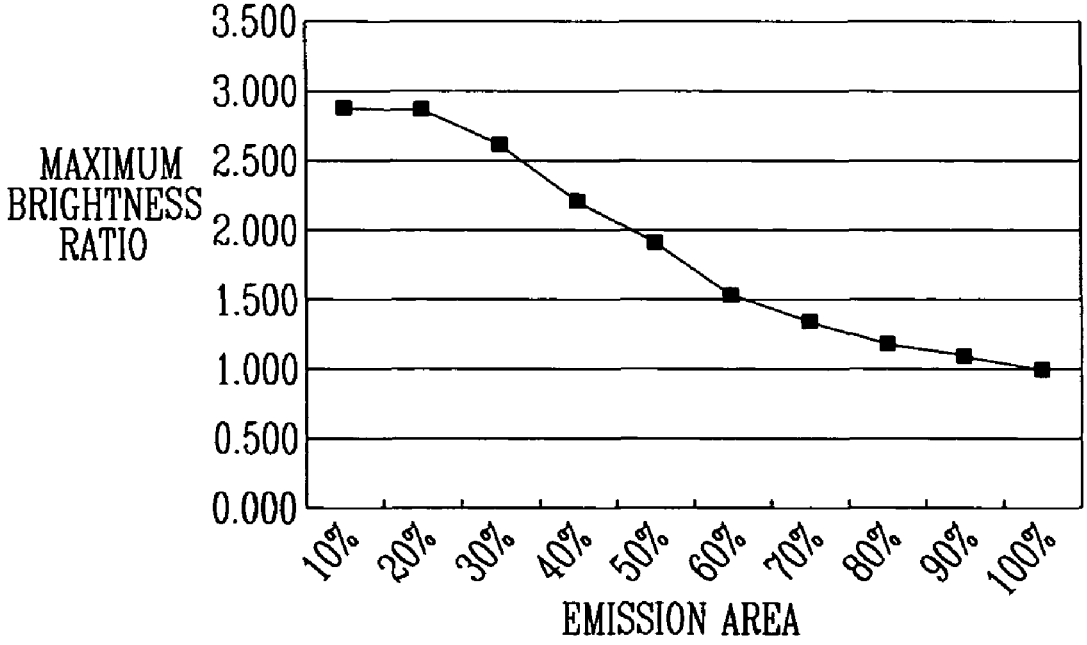
Figure 6C:
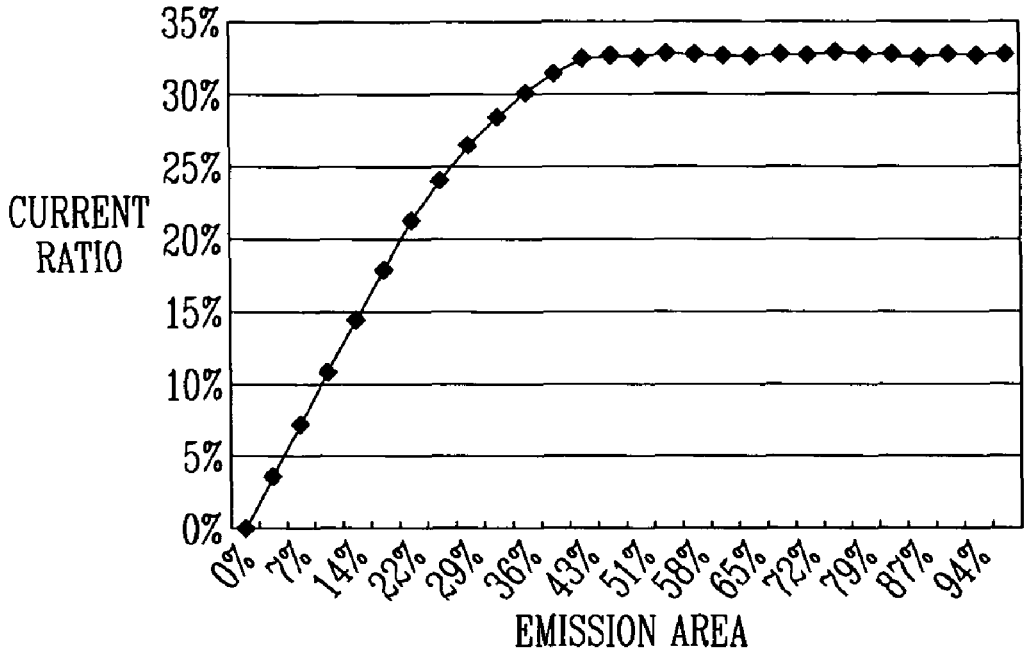
Figure 6D:
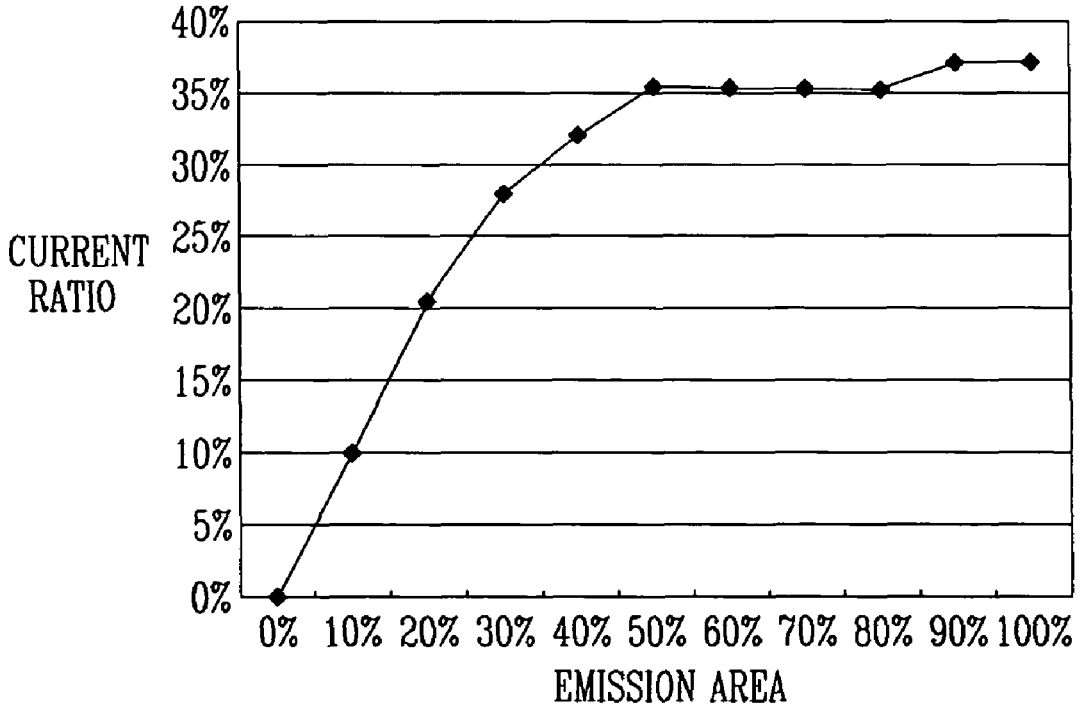

FIG. 6A, FIG. 6B, FIG. 6C, and FIG. 6D illustrate an exemplary embodiment of the present invention in which the emission ratio of the emission control signals input to the organic light emitting display is maximally restricted to 33%. FIG. 6A illustrates the mathematically calculated relationship between emission area and brightness ratio. FIG. 6B illustrates the measured relationship between emission area and brightness ratio. FIG. 6C illustrates the mathematically calculated relationship between emission area and current ratio. FIG. 6D illustrates the measured relationship between emission area and current ratio.

Referring to FIG. 6A and FIG. 6B, the brightness is maintained at a predetermined level so that the screen does not become dark when less than about 30% of the pixel area emits light brighter than a predetermined level. The brightness is gradually reduced when more than about 30% of the pixel area emits light that is brighter than a predetermined level so that the screen is not so bright that it dazzles viewers.

Referring to FIG. 6C and FIG. 6D, when the brightness is restricted, the amount of current used is about 30% to about 35% of the amount of current that is used when there is no brightness restriction. This reduces the load applied to the power source supply unit 500 so that the power source supply unit 500 need not have as high of an output.

Figure 7A:
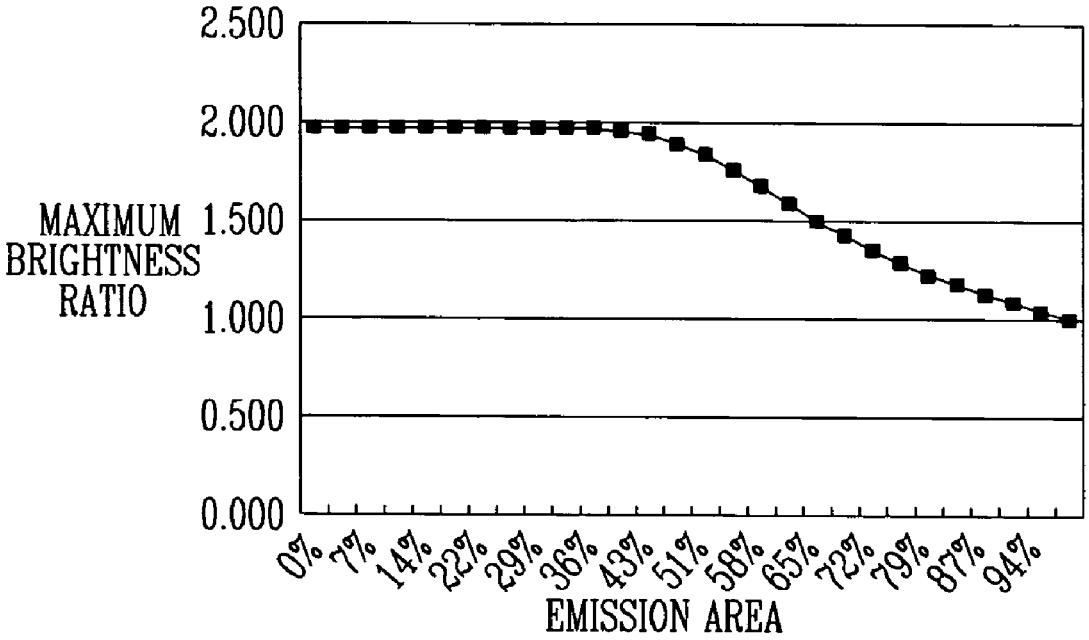
FIG. 7A, FIG. 7B, FIG. 7C, and FIG. 7D show cases in which restriction of 50% of the maximum current value of the light emitting display according to an exemplary embodiment of the present invention is performed.
Figure 7B:
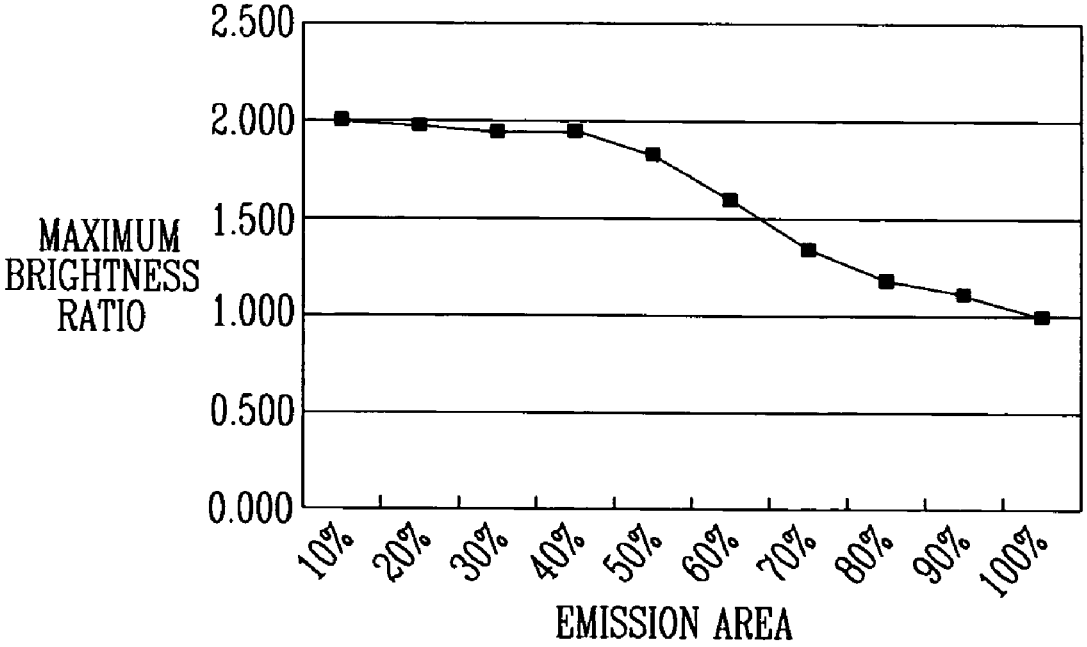
Figure 7C:
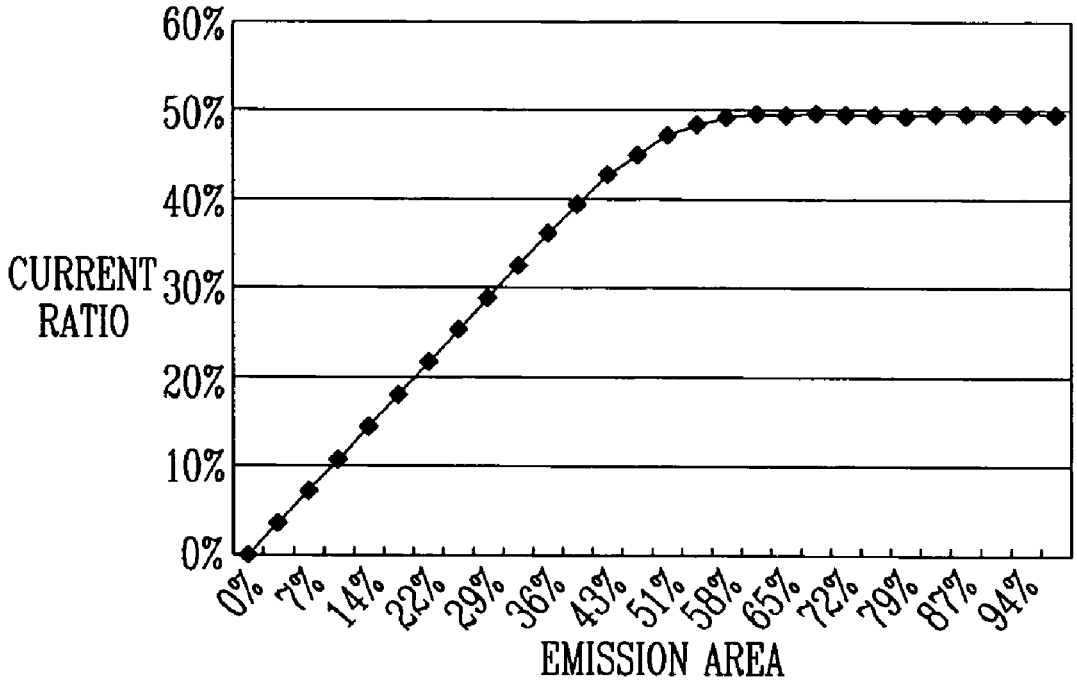
Figure 7D:
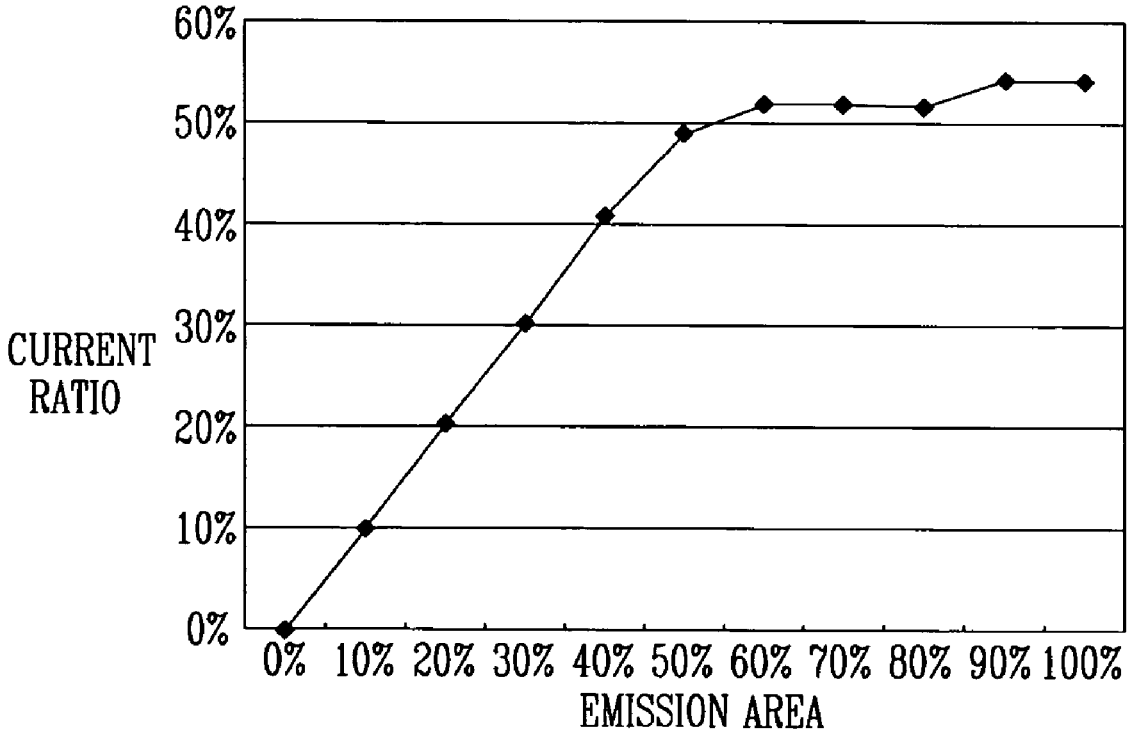

FIG. 7A, FIG. 7B, FIG. 7C and FIG. 7D illustrate an exemplary embodiment of the present invention in which the emission ratio of the emission control signals input to the organic light emitting display is maximally restricted to 50%. FIG. 7A illustrates a mathematically calculated relationship between emission area and brightness ratio. FIG. 7B illustrates the measured relationship between emission area and brightness ratio. FIG. 7C illustrates a mathematically calculated relationship between emission area and current ratio. FIG. 7D illustrates the measured relationship between emission area and current ratio.

Referring to FIG. 7A and FIG. 7B, the brightness is maintained at a predetermined level so that a screen does not become dark when less than about 40% of the pixel area emits light brighter than a predetermined level. The brightness is gradually reduced when more than about 40% of the pixel area emits light that is brighter than a predetermined level so that the screen is not so bright that it dazzles viewers.

Referring to FIG. 7C and FIG. 7D, when the brightness is restricted, the amount of current used is about 50% of the amount of current used when there is no brightness restriction. This reduces the load applied to the power source supply unit 500 so that the power source supply unit 500 need not have as high of an output.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display, comprising:

a pixel unit comprising a plurality of pixels;

a scan driver to transmit scan signals and emission control signals to the pixel unit;

a data driver to convert video data signals to data signals and to transmit the data signals to the pixel unit;

a brightness controller to restrict the brightness of the pixel unit by generating frame data by summing the video data corresponding to one frame and generating brightness control signals based on a magnitude of the frame data; and an emission controller to control the emission control signals in response to the brightness control signals received from the brightness controller, wherein the emission controller determines a number of emission periods per frame of the emission control signals based on the magnitude of the frame data, wherein the brightness controller restricts the brightness of the pixel unit by reducing a time per frame during which the plurality of pixels emit light.

2. The organic light emitting display of claim 1, wherein the emission control signals comprise a plurality of emission periods in one frame.

3. The organic light emitting display of claim 1, wherein the brightness controller does not restrict the brightness of the pixel unit when the magnitude of the frame data is below a predetermined level.

4. The organic light emitting display of claim 1, wherein the brightness controller comprises:

a data summing unit to sum the video data corresponding to one frame to generate the frame data;

a look-up table to store information correlating an emission time of the pixels to the magnitude of the frame data; and a brightness control driver to transmit the brightness control signals that control the emission control signals based on the information.

5. The organic light emitting display of claim 1, wherein brightness controller reduces the time per frame during which the pixels emit light by causing the pixels to not emit light during a plurality of time periods during the frame.

6. The organic light emitting display of claim 1, wherein the scan driver comprises a scan driving circuit to transmit the scan signals and an emission control driving circuit to transmit the emission control signals.

7. The organic light emitting display of claim 1, further comprising a look-up table to store information correlating an emission time of the pixels to the magnitude of the frame data, wherein entries in the look-up table are used to adjust the time per frame during which the plurality of pixels emit light, and wherein, per frame, the period of time during which light is not emitted is partitioned using the determined number of emission periods to decrease continuous intervals of time during which light is not emitted.

8. A method of driving an organic light emitting display, comprising:

generating frame data by summing video data corresponding to one frame;

determining, per frame, a number of emission periods of emission control signals based, at least in part, on a magnitude of the frame data; and restricting a brightness of a pixel unit in response to the magnitude of the frame data being greater than a predetermined level and not restricting the brightness of the pixel unit in response to the magnitude of the frame data being equal to or less than the predetermined level, wherein restricting the brightness of the pixel unit comprises reducing a time per frame during which pixels in the pixel unit emit light.

9. The method of claim 8, further comprising: reducing the time per frame during which the pixels emit light by causing the pixels to not emit light during a plurality of time periods during the frame.

10. The method of claim 8, wherein a length of the time during which the pixel unit emits light is controlled by the emission periods.

11. The method of claim 8, wherein the emission control signals comprise the plurality of emission periods in one frame.

12. The method of claim 11, wherein the emission periods of the emission control signals are determined by an emission time stored in a look-up table and correlated to the magnitude of the frame data.

13. The method of driving an organic light emitting display of claim 8, wherein, per frame, the period of time during which light is not emitted is partitioned using the determined number of emission periods to decrease continuous intervals of time during which light is not emitted.

* * * * *